US005565292A

United States Patent [19]

Nakadera et al.

[11] Patent Number: 5,565,292

[45] **Date of Patent: *Oct. 15, 1996**

[54] TONER FOR DEVELOPING ELECTROSTATIC IMAGE

[75] Inventors: Kazue Nakadera; Haruo Okutani; Hideki Kurebayashi, all of Shizuoka, Japan

[73] Assignee: Tomoegawa Paper Co., Ltd., Tokyo, Japan

[ * ] Notice: The term of this patent shall not extend beyond the expiration date of Pat. No. 5,447,814.

[21] Appl. No.: 523,119

[22] Filed: Sep. 1, 1995

Related U.S. Application Data

[63] Continuation-in-part of Ser. No. 331,948, Oct. 31, 1994, Pat. No. 5,447,814.

[30] Foreign Application Priority Data

Nov. 5, 1993 [JP] Japan ..... 5-301014

[51] Int. Cl.[6] ..... G03G 9/087

[52] U.S. Cl. ..... 430/109

[58] Field of Search ..... 430/109

[56] References Cited

U.S. PATENT DOCUMENTS

| | | | |
|---|---|---|---|
| 4,557,991 | 12/1985 | Takigiwa et al. | 430/109 |
| 4,601,966 | 7/1986 | Grashof et al. | 430/109 |
| 4,797,340 | 1/1989 | Tanaka et al. | 430/109 |
| 4,812,377 | 3/1989 | Wilson et al. | 430/109 |
| 5,032,484 | 7/1991 | Demejo et al. | 430/109 X |
| 5,147,750 | 9/1992 | Nakanishi | 430/110 |
| 5,348,831 | 9/1994 | Sacripante et al. | 430/109 |
| 5,447,814 | 9/1995 | Nakadera et al. | 430/109 |

FOREIGN PATENT DOCUMENTS

| | | | |
|---|---|---|---|
| 0333498 | 9/1989 | European Pat. Off. . | |
| 0587036 | 3/1994 | European Pat. Off. | 430/109 |
| 0617337 | 9/1994 | European Pat. Off. . | |
| 2256442 | 7/1975 | France . | |
| 3 411 103 | 9/1984 | Germany . | |
| 4 018 986 | 12/1990 | Germany . | |
| 49768 | 3/1988 | Japan | 430/109 |
| 1457070 | 12/1976 | United Kingdom . | |
| 2233105 | 1/1991 | United Kingdom . | |

*Primary Examiner*—Roland Martin
*Attorney, Agent, or Firm*—Wenderoth, Lind & Ponack

[57] ABSTRACT

A toner for developing an electrostatic image, which is excellent in low-temperature fixing properties, the prevention of offsetting and uniform chargeability, and which comprises a colorant and a polyester resin modified with an ethyleneimine derivative.

5 Claims, No Drawings

TONER FOR DEVELOPING ELECTROSTATIC IMAGE

This application is a continuation-in-part of application Ser. No 08/331,948, filed Oct. 31, 1994. now U.S. Pat. No. 5,447,814.

FIELD OF THE INVENTION

The present invention relates to a toner for developing an electrostatic image, used in electrophotography, an electrostatic recording process and an electrostatic printing process.

PRIOR ART OF THE INVENTION

In electrophotography, an electrostatic recording process and an electrostatic printing process, an electrostatic image formed on an electrostatic image support is visualized with toner particles composed mainly of a resin and a colorant. This visualized image is fixed on the electrostatic image support, or it is transferred to other receptor and then fixed. For this reason, the toner is required to have not only excellent developing properties but also excellent transfer and fixing properties. In recent years, a toner which can be fixed with low energy is increasingly demanded in view of energy saving.

A heat-fixing method is largely classified into a non-contact heating method such as oven-fixing and a contact heating method such as hot roller fixing. The contact heating method is preferable in view of energy saving, since it has advantages in that the heat efficiency is high, that the fixing portion requires no large electric power and that the fixing portion can be decreased in size. However, the problem with the contact heating method is that an offset phenomenon occurs. The offset phenomenon is that part of a toner forming an image transfers to the hot roller surface at a fixing time and is transferred to a subsequent support to contaminate an image. Therefore, various proposals have been made to overcome the above offset phenomenon.

One proposal is to incorporate a compound having releasability such as a wax into a toner, and this proposal is widely practiced. However, when this compound is incorporated into a toner, part of the wax adheres to a photoconductive drum, and a so-called filming is liable to take place. Further, the toner shows a poor shelf life. There is another proposal to incorporate a polymer having a high molecular weight into a resin constituting the toner. In this case, the offset phenomenon can be prevented. Impractically, however, this proposal involves problems in that a high fixing temperature is required since the softening point of the toner becomes high and that it is difficult to pulverize toner materials since the resin is tough.

For overcoming the above problems, there is proposed a toner containing a vinyl-containing polymer having a broad molecular weight distribution from a low molecular weight to a high molecular weight, such as polystyrene. This toner is satisfactory to some extent in offset prevention and fixing properties, while it is not at all satisfactory in fixing properties at a low temperature.

On the other hand, a resin obtained by polycondensation, typified by a polyester resin, can be obtained as a polymer having a relatively low molecular weight. There is therefore proposed a toner containing such a polymer. However, this toner has a problem in that an offset phenomenon takes place at a high temperature. Further, a toner containing a vinyl-containing polymer having a high molecular weight and a polyester resin having a low molecular weight is disclosed in JP-A-54-114245, JP-A-58-11955 and JP-A-58-14147. This toner has some effect on the prevention of an offset phenomenon when the temperature of a fixing roller increases over a predetermined fixing temperature. Since, however, it is difficult to mix the above two resins uniformly, the tribo-charge is liable to be non-uniform.

Further, toners containing a crosslinked polyester resin formed from monomers one of which is a trihydric or higher alcohol and/or a trivalent or more highly functional carboxylic acid are disclosed in JP-A-54-86342, JP-A-56-1952, JP-A-56-21136, JP-A-56-168660, JP-A-57-37353, JP-A-58-14146, JP-A-59-30542, JP-A-61-105561, JP-A-61-105563, JP-A-61-124961 and JP-A-61-275769. However, when the content of units from the polyhydric alcohol or the polyvalent carboxylic acid in the resin is 30 mol % or less, the crosslinking reaction does not fully proceed, and the effect on the prevention of an offset phenomenon is insufficient. When the above content is more than 30 mol %, there is an effect on the prevention of an offset phenomenon. However, unreacted alcoholic hydroxyl groups or carbonyl groups of the carboxylic acid are likely to remain, and the humidity resistance of the toner is greatly decreased.

SUMMARY OF THE INVENTION

It is an object of the present invention to provide a toner for developing an electrostatic image, which has excellent developing, transfer and fixing properties. It is another object of the present invention to provide a toner for developing an electrostatic image, which is excellent in fixing properties at a low temperature and has an excellent effect on the prevention of an offset phenomenon.

It is further another object of the present invention to provide a toner for developing an electrostatic image, which is suitable for use in a contact heating method preferred in view of energy saving.

According to the present invention, there is provided a toner for developing an electrostatic image, which comprises a binder resin and a colorant, the binder resin being a polyester resin modified with an ethyleneimine derivative.

DETAILED DESCRIPTION OF THE INVENTION

In the present invention, the binder resin is a polyester resin modified with an ethyleneimine derivative. The ethyleneimine derivative includes ethyleneimine, 1-(2-aminoethyl)ethyleneimine, 1-(2-hydroxyethyl)ethyleneimine, 1-(p-toluenesulfonyl)ethyleneimine, 1-carbamylethyleneimine, 2-(1-aziridyl)ethyl methacrylate, vinyl 2-aziridylpropionate allylacetate, 1,1'-carbonylbisethyleneimine, 1,6-hexamethylenediethyleneurea, diphenylmethane-bis-4,4'-N,N'-ethyleneurea, 2,4-diethyleneureatoluidine, tris-1-aziridinylphosphine sulfide, tris-1-aziridinylphosphine oxide, tris[1-(2-methyl)aziridinyl]phosphine oxide, tris-2,4,6-(1-azridinyl)-1,3,5-triazine, ω-aziridinylpropionic acid-2,2'-dihydroxylmethylbutanol-triester, and hexa[1-( 2-methyl)-aziridinyl]triphosphortriazine.

The ethyleneimine derivative reacts with functional groups of a polyester such as carboxyl, hydroxyl, amino, sulfonic acid, unsaturated and epoxy groups to introduce amino and urea groups into the resin. The ethyleneimine derivative is used in such an amount that 1 to 100 mol % of the functional groups of the resin are modified with the ethyleneimine derivative. Further, a negatively chargeable polyester resin is converted to a positively chargeable resin by reacting the ethyleneimine derivative with the negatively chargeable polyester. Further, the resin can be crosslinked when a compound having at least two ethyleneimine groups is employed.

As the polyester used in the present invention,preferred is a polyester obtained by the polycondensation of a composition which mainly contains a diol component, at least one of a dicarboxylic acid and its lower alkyl ester and at least one of a carboxylic acid containing a phenolic hydroxyl group and its lower alkyl ester.

The diol component includes diethanolamine, ethylene glycol, diethylene glycol, propylene glycol, isoprene glycol, octanediol, 2,2-diethyl-1,3-propanediol, spiroglycol, neopentyl glycol, 1,3-butanediol, 1,4-butanediol, 2-butyl-2-ethyl-1,3-propanediol, 1,6-hexanediol, hexylene glycol, 1,5-pentanediol, 3-methyl-1,5-pentanediol, hydrobenzoin, bis(β-hydroxyethyl)terephthalate, bis(hydroxybutyl)terephthalate, polyoxyethylenated bisphenol A, polyoxypropylenated bisphenol A, polyoxyethylenated biphenol and polyoxypropylenated biphenol. Further, when the polyester resin used in the present invention is produced by polycondensation, a polyol may be added as required. The polyol can be selected from glycerin, trimethylol propane, trimethylol ethane, triethanolamine, pentaerythritol, sorbitol, glycerol and 1,3,5-trihydroxymethylbenzene.

The dicarboxylic acid and its lower alkyl ester include fumaric acid, maleic acid, succinic acid, itaconic acid, mesaconic acid, citraconic acid, glutaconic acid, phthalic acid, isophthalic acid, terephthalic acid, cyclohexanedicarboxylic acid, cyclohexenedicarboxylic acid, adipic acid, sebacic acid, dodecanoic diacid, naphthalenedicarboxylic acid, biphenyl-4,4'-dicarboxylic acid, 2,3-piperazine-dicarboxylic acid, iminodicarboxylic acid, imidazole-4,5-dicarboxylic acid, piperidinedicarboxylic acid, pyrazoledicarboxylic acid, N-methylpyrazoledicarboxylic acid, N-phenylpyrazoledicarboxylic acid, pyridinedicarboxylic acid, carbazole-3,6-dicarboxylic acid, 9-methylcarbazole-3,6-dicarboxylic acid, carbazole-3,6-dibutyric acid, carbazole-3,6-γ,γ'diketobutyric acid and lower alkyl esters of these.

When the polyester resin used in the present invention is produced by polycondensation, a polycarboxylic acid and its alkyl ester may be added. The polycarboxylic acid and its alkyl ester include trimellitic acid, pyromellitic acid, 1,2,4-cyclohexanetricarboxylic acid, 1,2,4-naphthalenetricarboxylic acid, 2,5,7-naphthalenetricarboxylic acid, pyridinetricarboxylic acid, pyridine-2,3,4,6-tetracarboxylic acid, 1,2,7,8-tetracarboxylic acid, anhydrides of these acids, and lower alkyl esters of these acids.

The dicarboxylic acid containing a phenolic hydroxyl group and its lower alkyl ester include 4-hydroxyisophthalic acid, 5-hydroxyisophthalic acid, 4,6-dihydroxyisophthalic acid, 2,5-dihydroxy-1,4-benzene diacetic acid, chelidamic acid, bis(2-hydroxy-3-carboxyphenyl)methane, and lower alkyl esters of these.

The amount ratio of the diol component, at least one of the dicarboxylic acid and its lower alkyl ester and at least one of the carboxylic acid containing a phenolic hydroxyl group and its lower alkyl ester for producing the polyester resin may be varied as required for controlling the hydroxyl value and the acid value of the polyester resin and the content of the phenolic hydroxyl group in the polyester resin.

The polyester resin used in the present invention preferably has a glass transition temperature, measured with a differential scanning calorimeter, of at least 50° C. and a flow softening point, measured with a flow tester, of 80° to 150° C. When the above glass transition temperature is lower than 50° C., the storage stability of the toner is decreased. When the above flow softening point is lower than 80° C., the storage stability of the toner is decreased. When the above flow softening point exceeds 150° C., undesirably, it is difficult to fix an image of the toner with low energy.

The toner for developing an electrostatic image is produced by dispersing and mixing a colorant, a charge control agent and optionally a magnetic powder in/with the binder resin. The colorant includes carbon black, aniline blue, phthalocyanine blue, quinoline yellow, malachite green, lamp black, Rhodamine B and quinacridone. The colorant is generally used in an amount of 1 to 20% by weight of the binder resin.

The polyester resin of the present invention is contained in an amount of more than 50% by weight based on the total amount of the toner.

The charge control agent is grouped into those for positive charge and those for negative charge. The charge control agent for positive charge includes nigrosine dye, ammonium salt, pyridinium salt and azine. The charge control agent for positive charge is generally used in an amount of 0.1 to 10% by weight of the polyester resin. The charge control agent for negative charge includes chromium complex and iron complex.

The present invention will be explained more in detail hereinafter with reference to Examples.

SYNTHESIS EXAMPLE 1

A four-necked round-bottomed flask having a stirrer, a condenser and a nitrogen gas introducing tube was charged with 316 g (1 mol) of 2,2'-bis-[4-(2-hydroxyethyleneoxy)phenyl]propane, 133 g (0.8 mol) of isophthalic acid, 42 g (0.2 mol) of dimethyl 5-hydroxyisophthalate, 2.5 g of zinc acetate dihydrate and 2.5 g of dibutyltin oxide, and while a nitrogen gas was introduced through the nitrogen gas introducing tube, the mixture was heated to 200° C. After the termination of the distilling of methyl alcohol and water off, the reaction mixture was temperature-increased up to 230° C. over 1 hour, and further maintained at this temperature for 4 hours. The resultant resin had an acid value of 0.9 KOH mg/g. 100 Grams of this resin and 0.14 g (corresponding to 100 mol % of carboxylic acid groups of the resin) of 1-(2-aminoethyl)ethyleneimine were placed in a container having a condenser, fully mixed, then heated to 120° C. under nitrogen current with stirring, and maintained for 1 hour. The resultant resin had a glass transition temperature, measured with DSC, of 67° C., a melting initiation temperature, measured with a Koka type flow tester, of 99° C., a flow softening point of 115° C. and an acid value of 0.

SYNTHESIS EXAMPLE 2

253 g (0.8 mol) of 2,2'-bis-[4-(2-hydroxyethyleneoxy)phenyl]propane, 31 g (0.3 mol) of neopentyl glycol, 97 g (0.5 mol) of dimethyl isophthalate, 74 g (0.5 mol) of phthalic anhydride and 21 g (0.1 mol) of trimellitic acid were allowed to react in the same manner as in Synthesis Example 1 to obtain a resin. The resin had a glass transition temperature of 59° C., a melting initiation temperature of 86° C., a flow softening point of 102° C. and an acid value of 20.4 KOH mg/g.

100 Grams of the above resin powder and 1.38 g (corresponding to 15 mol % of carboxylic acid groups of the resin) of 1,6-hexamethylenediethyleneurea were placed in a container having a condenser, fully mixed, then heated to 120° C. under nitrogen current with stirring, and maintained for 1 hour. The resultant resin had a glass transition temperature of 61° C., a melting initiation temperature of 89° C. a flow softening point of 107° C. and an acid value of 14.6 KOH mg/g.

SYNTHESIS EXAMPLE 3

A four-necked round-bottomed flask having a stirrer, a condenser and a nitrogen gas introducing tube was charged with 253 g (0.8 mol) of 2,2'-bis-[4-(2- hydroxyethyleneoxy)phenyl]propane, 31 g (0.3 mol) of neopentyl glycol, 97 g (0.5 mol) of dimethyl isophthalate, 74 g (0.5 mol) of phthalic anhydride, 21 g (0.1 mol) of trimellitic acid and 2.3 g of 1,6-hexamethylenediethyleneurea, and under nitrogen current, the mixture was temperature-increased up to 180° C. over about 2 hours. Then, the reaction mixture was maintained at 200° C. for 1 hour, and then at 220° C. for 3 hours. After the termination of distillation of methyl alcohol and water off, the pressure in the flask was decreased, and the reaction mixture was further allowed to react for 2 hours. The resultant resin had a glass transition temperature of 60° C., a melting initiation temperature of 86° C., a flow softening point of 100° C. and an acid value of 10 KOH mg/g.

COMPARATIVE SYNTHESIS EXAMPLE 1

A polyester resin was prepared in the same manner as in Synthesis Example 1 except that the modification with 1-(2-aminoethyl)ethyleneimine was not carried out. This resin had a glass transition temperature of 67° C. a melting initiation temperature of 98° C. and a flow softening point of 116° C.

COMPARATIVE SYNTHESIS EXAMPLE 2

A polyester resin was prepared in the same manner as in Synthesis Example 2 except that the modification with 1,6-hexamethylenediethyleneurea was not carried out. This resin had a glass transition temperature of 59° C., a melting initiation temperature of 86° C. and a flow softening point of 102° C.

EXAMPLE 1

Resin obtained in Synthesis Example 1

| | |
|---|---|
| Resin obtained in Synthesis Example 1 | 100 parts by weight |
| Carbon black ("MA-100", supplied by Mitsubishi Kasei Corporation) | 5 parts by weight |
| Nigrosine dye ("Bontron", supplied by Orient Chemical Industries, Ltd.) | 2 parts by weight |

A mixture of the above components was melt-kneaded with a twin-screw kneader at about 150° C. The kneaded mixture was cooled, pulverized and classified to give positively chargeable toner particles having an average particle diameter of 10 μm. 0.5 Parts by weight of hydrophobic colloidal silica was added to the above positively chargeable toner particles to give a toner of the present invention.

The above toner and a ferrite carrier were mixed in a toner/carrier mixing weight ratio of 5/95 to prepare a two-component developer. The developer was measured for a charge distribution of particles with a q/d meter supplied by PES-LABORATORIUM to show no inclusion of adversely charged particles.

An image was picked up with a commercially available copying machine, and a toner image was heat-fixed on a paper sheet with a fixing apparatus including a fixing roller surface-coated with Teflon and a platen roller surface-covered with a silicone rubber. The fixing roller had a surface temperature of 130°±5° C. and a linear velocity of 200 mm/second. In this case, no offsetting took place. The fixed image was rubbed with a cotton pad, and the fixing strength was calculated by the following equation and used as an index for low energy fixing properties. In addition, the image density was measured with a Macbeth reflection densitometer RD-914.

Fixing strength=[Image density of fixed image after rubbing/image density of fixed image before rubbing]×100 (%).

The obtained fixing strength was 87%, which was sufficient in practical use.

EXAMPLE 2

Resin obtained in Synthesis Example 2

| | |
|---|---|
| Resin obtained in Synthesis Example 2 | 100 parts by weight |
| Carbon black ("#40", supplied by Mitsubishi Kasei Corporation) | 5 parts by weight |
| Quaternary ammonium salt-containing dye ("Bontron P-51", supplied by Orient Chemical Industries, Ltd.) | 2 parts by weight |

Positively chargeable toner particles having an average particle diameter of 8 μm were obtained from the above components in the same manner as in Example 1. The kneaded mixture showed excellent pulverizability over that in Example 1. Then, a toner and a two-component developer were obtained in the same manner as in Example 1. The two-component toner was tested for fixing properties in the same manner as in Example 1, to show that it underwent no offsetting and it had a fixing strength of 95, which was satisfactory in practical use.

EXAMPLE 3

Resin obtained in Synthesis Example 3

| | |
|---|---|
| Resin obtained in Synthesis Example 3 | 100 parts by weight |
| Carbon black ("#40", supplied by Mitsubishi Kasei Corporation) | 5 parts by weight |
| Chromium-containing complex salt dye ("TRH", supplied by Hodogaya K.K. | 2 parts by weight |

Positively chargeable toner particles having an average particle diameter of 8 μm were obtained from the above components in the same manner as in Example 1. Then, a toner and a two-component developer were obtained in the same manner as in Example 1. The two-component toner was tested for heat fixing properties in the same manner as in Example 1, to show that it underwent no offsetting and it had a fixing strength of 97, which was fully satisfactory in practical use.

When each of the two-component developers obtained in Examples 1 to 3 was used with a commercially available copying machine for continuously making 10,000 copies, all of the obtained copies showed that their solid images had a Macbeth reflection density of at least 1.4, and that their non-image portion had a fog density of 0.1 or less. That is, there were obtained images which had image qualities having no problem in practical use.

COMPARATIVE EXAMPLE 1

Resin obtained in Comparative Synthesis Example 1

| | |
|---|---|
| Resin obtained in Comparative Synthesis Example 1 | 100 parts by weight |
| Carbon black ("#40", supplied by Mitsubishi Kasei Corporation) | 5 parts by weight |
| Nigrosine dye ("Bontron NO-4", supplied by Orient Chemical Industries, Ltd.) | 2 parts by weight |

A two-component developer was prepared from the above components in the same manner as in Example 1, and the developer was measured for a charge distribution of particles to show the inclusion of negatively chargeable particles. The two-component developer was tested for heat fixing properties in the same manner as in Example 1, to show that it had a fixing strength of 85% which was sufficient, but that it underwent offsetting. Further, when it was used with a commercially available copying machine for continuously making 10,000 copies, it showed a fog density of 0.2 (measured with a Macbeth reflection densitometer), which had a problem in image quality.

COMPARATIVE EXAMPLE 2

A two-component developer was prepared in the same manner as in Example 2 except that the resin obtained in Synthesis Example 2 was replaced with the resin obtained in Comparative Synthesis Example 2. The two-component developer was measured for a charge distribution of particles to show the inclusion of negatively chargeable particles. The developer was tested for heat fixing properties in the same manner as in Example 1, to show that it had a fixing strength of 75% which was sufficient, but that it underwent offsetting.

COMPARATIVE EXAMPLE 3

350 Grams (1.02 mol) of 2,2'-bis[4-(2-hydroxypropyleneoxy)phenyl]propane, 199 g (1.2 mol) of terephthalic acid and 2.5 g of dibutyltin oxide were placed in a four-necked round-bottomed flask having a stirrer, a condenser and a nitrogen-introducing tube, and the mixture was subjected to polycondensation by heating it up to 220° C. while nitrogen gas was introduced, to give a polyester (1) having an acid value of 50 mgKOH/g and a hydroxyl value of 9 mgKOH/g. Separately, 99 g (1.0 mol) of tert-butylaziridine was dissolved in 1,000 g of a tetrahydrofuran/hexamethylphosphorictriamide (9/1) mixture, and 8.3 g of methyltrifluoromethane sulfonic acid methyl ester) was added at 15° C. After 5 minutes, 100 g of the polyester (1) was added, and the mixture was allowed to further react for 1 hour. The reaction mixture was dropwise added to methanol, precipitated, filtered and dried to give a polymer (1). The polymer (1) was used as a charge control agent.

(SYNTHESIS OF BINDER RESIN)

350 Grams (1.12 mol) of 2,2'-bis[4-(2-hydroxyethyleneoxy)phenyl]propane, 183 g (1.1 mol) of terephthalic acid, 21 g (0.1 mol) of trimellitic acid and 2.5 g of dibutyltin oxide were placed in a four-necked round-bottomed flask having a stirrer, a condenser and a nitrogen-introducing tube, and the mixture was subjected to polycondensation by heating it up to 220° C. while nitrogen gas was introduced, to give a polyester (2) having a number average molecular weight of 4,500 and a weight average molecular weight of 120,000.

| (Preparation of Toner) | part by weight |
|---|---|
| Polyester (2) as binder | 840 |
| Polymer (1) as charge control agent | 150 |
| Carbon black ("MA-11", supplied by Mitsubishi Kasei Corporation) | 10 |

A mixture of the above components was melt-kneaded in a twin-screw kneader at about 150° C. Then, the kneaded mixture was cooled, pulverized and classified to give toner particles having an average particle diameter of 10 μm. Hydrophobic colloidal silica in an amount of 0.,5 parts by weight was added to 100 parts by weight of the above toner particles, to obtain a toner.

(Evaluation of Toner)

The above toner and a ferrite carrier were mixed in a weight ration of 5/95 (toner/carrier), to give a two-component developer.

Then, an unfixed toner image was formed on a woodfree paper sheet with a commercially available copying machine, and heat-fixed on the paper sheet with a fixing apparatus including a fixing roller surface-coated with Teflon and a platen roller surface-coated with a silicone rubber. The fixing roller had a surface temperature of 130°±5° C. and a linear velocity of 200 mm/second.

As a result, an offsetting occurred, and it was found that the toner had a problem in the property of fixing at a low temperature.

As explained above, according to the present invention, there is provided a toner for developing an electrostatic image, which is excellent in low-temperature fixing properties, the prevention of offsetting and uniform chargeability.

What is claimed is:

1. A toner for developing an electrostatic image, which comprises a binder resin and a colorant, the binder resin being a polyester resin modified with an ethyleneimine derivative, the polyester resin being present in an amount of more than 50% by weight based on the total weight of the toner.

2. A toner according to claim 1, wherein the polyester resin is a resin obtained by polycondensation of a composition which mainly contains a diol component, at least one of a dicarboxylic acid and its lower alkyl ester and at least one of a carboxylic acid containing a phenolic hydroxyl group and its lower alkyl ester.

3. A toner according to claim 1, wherein 1 to 100 mol % of functional groups of the polyester resin are modified with the ethyleneimine derivative.

4. A toner according to claim 1, wherein the polyester resin has a glass transition temperature, measured with a differential scanning calorimeter, of at least 50° C.

5. A toner according to claim 1, wherein the polyester resin has a flow softening point, measured with a flow tester, of 80° to 150° C.

* * * * *